United States Patent [19]

Lin

[11] Patent Number: 5,047,901

[45] Date of Patent: Sep. 10, 1991

[54] STRUCTURE OF ROTARY LAMP FOR VARIABLE STAGE ILLUMINATION

[76] Inventor: Yu-Chuan Lin, 1F, No. 103, San Yang Road, San Chung, Taipei, Taiwan

[21] Appl. No.: 531,896

[22] Filed: Jun. 1, 1990

[51] Int. Cl.[5] ..... F21V 21/30

[52] U.S. Cl. ..... 362/35; 362/251; 362/228; 362/272; 362/386

[58] Field of Search ..... 362/35, 221, 228, 269, 362/272, 386, 251, 12

[56] References Cited

U.S. PATENT DOCUMENTS 2,984,738 5/1961 Belau ..... 362/35

FOREIGN PATENT DOCUMENTS 289678 10/1913 Fed. Rep. of Germany ..... 362/35

*Primary Examiner*—Stephen F. Husar

*Attorney, Agent, or Firm*—Bucknam and Archer

[57] ABSTRACT

Disclosed is a rotary lamp for stage lighting control, which utilizes a four-step control switch to control a long lamp and two short lamps which are respectively mounted on a revolving shaft of a seat to rotate at a constant speed.

1 Claim, 2 Drawing Sheets

STRUCTURE OF ROTARY LAMP FOR VARIABLE STAGE ILLUMINATION

BACKGROUND OF THE INVENTION

The present invention is relates to lighting equipment and more particularly to a rotary lamp for variable stage illumination.

In stage performance, lighting control is very important to create electric atmosphere and produce a general feeling of great excitement. Recently, rotary lamps have been commonly used by stage designer to match with colored glass for producing variable lighting effect. For stage lighting control according to conventional methods, a variety of lamps of different luminous intensity are mounted at different locations around a stage. During performance, the lamps are respectively controlled by means of respective control switches. It is indeed costly and occupies much space to install several lamps to illuminate a stage and inconvenient to control several lamps through several control switches.

The present invention has been accomplished to settle the afore-said problems. It is one object of the present invention to provide a rotary lamp which can be controlled for variable stage illumination through a single control switch.

According to the present invention, a rotary lamp for variable stage illumination comprises a seat having a revolving shaft with a long lamp and two short lamps mounted thereon. The two short lamps are bilaterally disposed in vertical to the long lamp and respectively connected to a four-step control switch. By means of the control of the four-step control switch, the lamps are alternately or concurrently turned on to produce light while they are carried by the revolving shaft to rotate.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
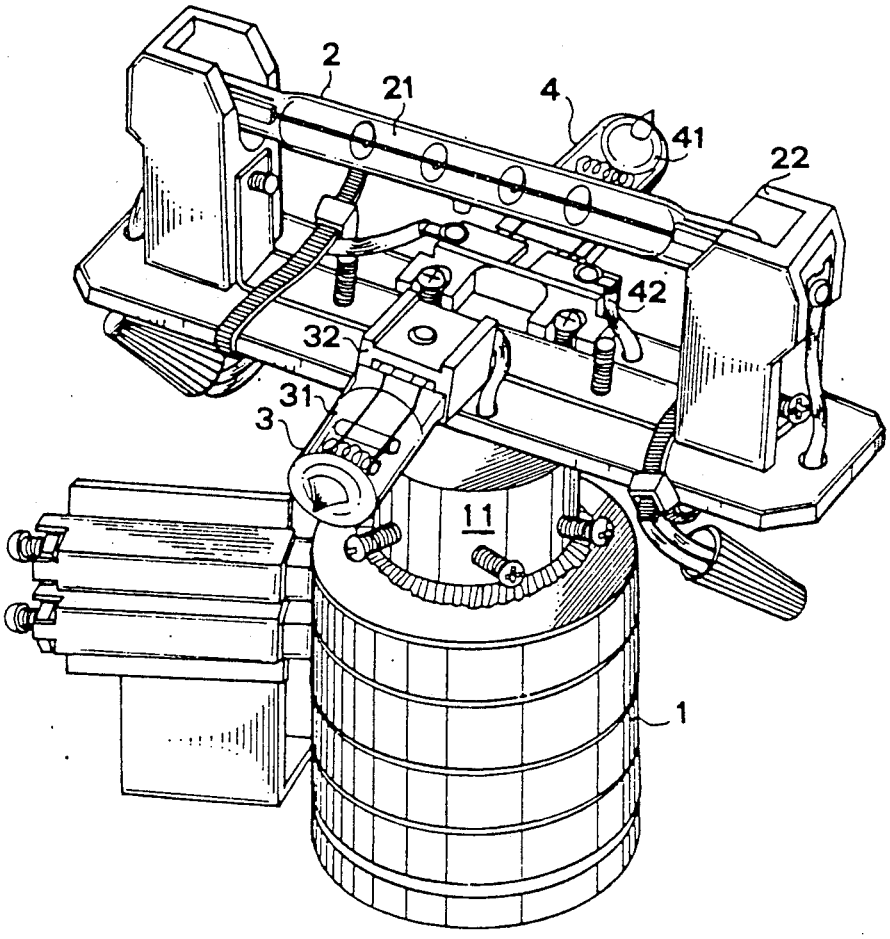
FIG. 1 is a perspective view of a rotary lamp embodying the present invention.

Referring to FIG. 1, there is illustrated a rotary lamp embodying the present invention and generally comprised of a rotary seat 1 having mounted thereon a first lamp 2, a second lamp 3 and a third lamp 4.

The rotary seat 1 is a stand having a shaft 11 for mounting lamps, which shaft is driven to rotate at a constantly speed in a horizontal plane, as can be seen from FIG. 1.

The first lamp 2 comprises an elongated lamp tube 21 mounted on a lamp holder 22 which is secured to follow the shaft 11 of the rotary seat 1 to rotate.

The second and third lamps 3 and 4 are respectively mounted at both sides of and at right angles with respect to the first lamp 2 as can be seen from FIG. 1, to follow the shaft 11 to rotate, and each comprised of a lamp tube 31 or 41 mounted on a lamp holder 32 or 42. In comparison with the first lamp 2, the second and third lamps 3 and 4 are relatively smaller in size.

Figure 2:
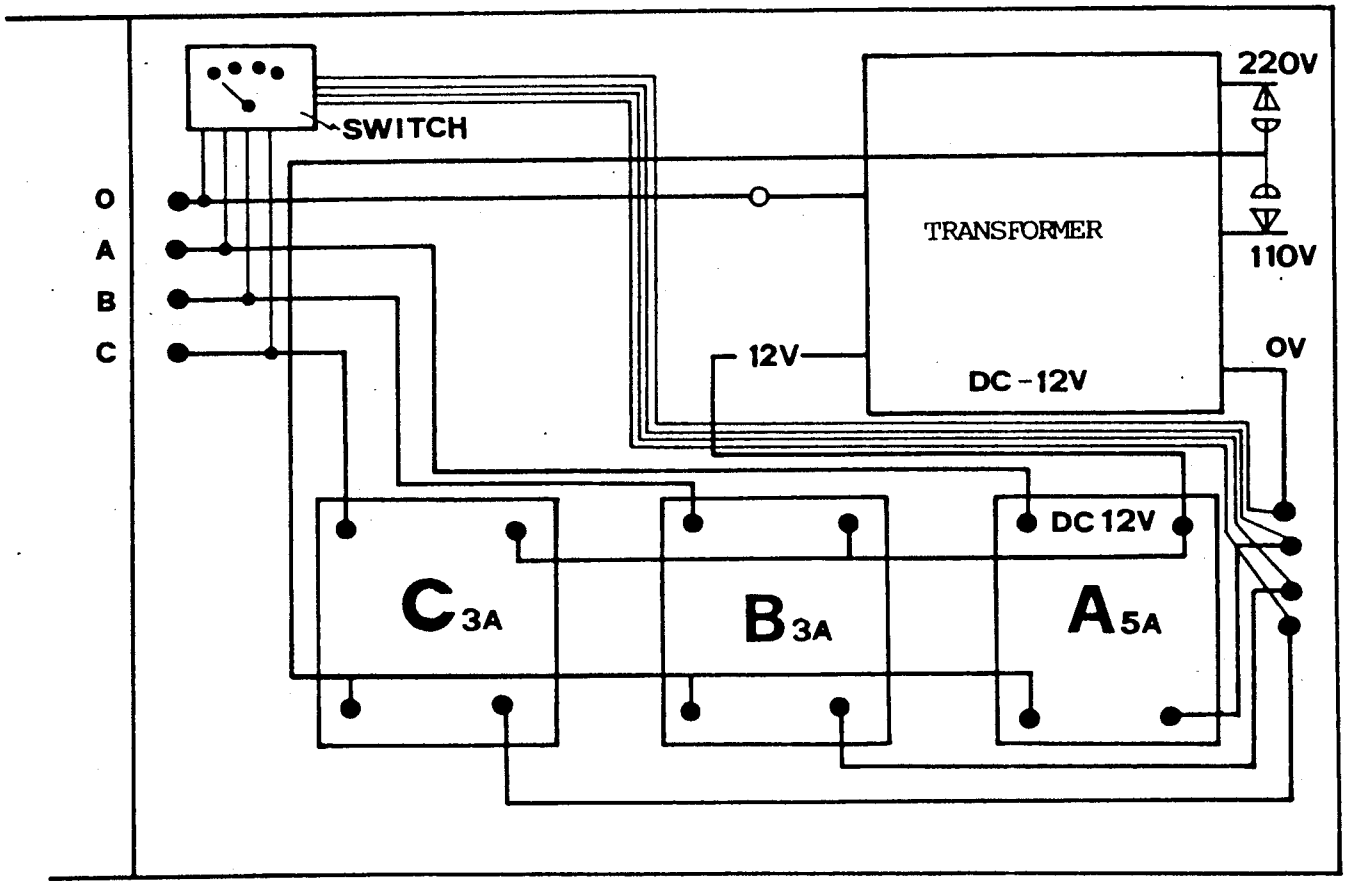
FIG. 2 is a circuit diagram of the present invention.

Referring to the circuit diagram of FIG. 2, the lamps are respectively connected to a control switch via respective electric circuits. In the present embodiment, DC-12V transformer is used, and the current is 5A for the first lamp or 3A for the second and third lamp.

According to the present invention, the control switch can be designed for four-step control, i.e. ON/-OFF, First Lamp, Second Lamp and Third Lamp control. By means of controlling the control switch and changing the colored glass which mounted in the front of the rotary lamp, a variable lighting effect can be shown on a stage.

It is to be understood that the drawings and foregoing specification are for better understanding of the present invention and not intended as a definition of the limits and scope of the invention disclosed.

What is claimed is:

1. A rotary lamp for stage lighting control comprising a seat having a revolving shaft controlled to rotate at a constant speed in a horizontal plane, an elongated lamp included an elongated lamp tube mounted on a lamp holder, said lamp holder being connected and secured to said seat, whereby said lamp holder rotates when the shaft rotates, two short lamps, each including a short lamp tube mounted on a respective lamp holder, said two short lamps being mounted on respective opposite sides of said elongated lamp, and at right angles thereto, whereby said short lamps rotate when said shaft rotates, a single four-step control switch controllable to selectably switch on said elongated long lamp, one or both of said short lamps, and all of said lamps, and being electrically connected with said elongated lamp, and with said two short lamps for respectively controlling the operation of said elongated lamp and said two short lamps, said lamps being supplied with a voltage of 12 volts derived from a single mains supply, said elongated lamp being designed to have a current of 5 Amperes pass therethrough, said short lamps being designed to have a current of 3 Amperes pass therethrough.

* * * * *